US009573253B1

(12) United States Patent
Chen

(10) Patent No.: US 9,573,253 B1
(45) Date of Patent: Feb. 21, 2017

(54) RATCHET WRENCH STRUCTURE

(71) Applicant: Chia-Yu Chen, Taichung (TW)

(72) Inventor: Chia-Yu Chen, Taichung (TW)

( * ) Notice: Subject to any disclaimer, the term of this patent is extended or adjusted under 35 U.S.C. 154(b) by 0 days.

(21) Appl. No.: 14/963,607

(22) Filed: Dec. 9, 2015

(51) Int. Cl.

| | |
|---|---|
| ***B25B 13/46*** | (2006.01) |
| ***B25B 13/00*** | (2006.01) |
| *B25B 13/06* | (2006.01) |
| *B25B 13/10* | (2006.01) |

(52) U.S. Cl.
CPC ..... *B25B 13/463* (2013.01); *B25B 13/005* (2013.01); *B25B 13/06* (2013.01); *B25B 13/102* (2013.01)

(58) Field of Classification Search
CPC .... B25B 13/463; B25B 13/005; B25B 13/102; B25B 13/06; B25B 13/04; B25B 13/56
USPC ..... 81/124.5, 60–63.2
See application file for complete search history.

(56) References Cited

U.S. PATENT DOCUMENTS 2,701,977 A * 2/1955 Stone ..... B25B 13/463 81/63.2
5,522,288 A * 6/1996 Slusar ..... B25B 13/463 81/63
5,557,994 A * 9/1996 Nakayama ..... B25B 13/461 73/862.23
6,145,412 A * 11/2000 Cheng ..... B25B 17/00 81/57.29
6,164,167 A * 12/2000 Chen ..... B25B 13/463 81/63
6,647,833 B1 * 11/2003 Wu ..... B25B 13/463 81/60
6,860,175 B2 * 3/2005 Hu ..... B25B 13/463 81/58.1
6,971,286 B2 * 12/2005 Hu ..... B25B 23/0035 81/124.3
7,237,460 B2 * 7/2007 Hu ..... B25B 13/463 192/43.2
7,861,620 B2 * 1/2011 Arnold ..... B25B 13/463 81/63
2003/0010159 A1 * 1/2003 Hu ..... B25B 13/463 81/63.2
2013/0213190 A1 * 8/2013 Chen ..... B25B 1/02 81/63.2

(Continued)

*Primary Examiner* — Monica Carter
*Assistant Examiner* — Danny Hong
(74) *Attorney, Agent, or Firm* — Ming Chow; Sinorica, LLC

(57) ABSTRACT

A ratchet wrench structure includes a main body provided therein with a ratchet wheel, an actuating member and a restraining block positioned between the ratchet wheel and the actuating member. The restraining member has one side provided with two recessed portions, and the actuating member is provided with a position-limiting groove corresponding with the recessed portion, and an elastic member. When the actuating member is rotated, the elastic member will be actuated to push the recessed portion to have its front edge longitudinally and evenly pressing the recessed portion to enable the elastic member to support the restraining block in its entirety. Further, when the restraining block is stressed by rotation of the ratchet wheel, the restraining block can carry out reciprocating movement because of extension and contraction of the elastic member. Thus, the ratchet wrench structure can be simplified in number of components.

4 Claims, 8 Drawing Sheets

(56) References Cited

U.S. PATENT DOCUMENTS

2013/0283982 A1* 10/2013 Hopper ..... B25B 13/463
81/63.1

* cited by examiner

RATCHET WRENCH STRUCTURE

BACKGROUND OF THE INVENTION

1. Field of the Invention

This invention relates to a ratchet wrench, particularly to a ratchet wrench structure.

2. Description of the Prior Art

A conventional ratchet wrench, referring to FIGS. 1 and 2, has one end provided with an accommodating groove 1 received therein with a ratchet wheel 2, which has its circumferential side circularly provided with gear teeth. An actuating member 3 is pivotally received in the accommodating groove 1 and a restraining block 4 is slidably mounted between the ratchet wheel 2 and the actuating member 3. The restraining block 4 has one side adjacent to the ratchet wheel 2 disposed thereon with gear teeth to be engaged with the gear teeth of the ratchet wheel 2 and another side formed with two recessed portions 5. The actuating member 3 is provided with a position-limiting groove 6 corresponding with the recessed portion 5, a push block 7 and an elastic piece 8. The sealing end of the position-limiting groove 6 is connected with the push block 7 via the elastic piece 8 to let the push block 7 actuated to push against the restraining block 4.

Thus, by the force of rotation of the ratchet wheel and via the force exerted by the push block 7, the restraining block 4 will be actuated to push against the elastic member 8 and carry out reciprocating movement by extension and contraction of the elastic piece 8. When the actuating member 3 is turned, the elastic piece 8 will be actuated by the push block 7 to optionally push one of the two recessed portions 5 of the restraining block 4 and have one corresponding sidewall of the restraining block 4 resisting against the inner wall of accommodating groove 1. At this time, the ratchet wheel 2 is limited by the restraining block 4; therefore, the ratchet wheel 2 can be only rotated clockwise or counterclockwise, thus able to attain an effect that the actuating member 3 can be actuated to control the ratchet wheel 2 to carry out unidirectional driving.

However, there is an excessively large disparity in size ratio between the area of the pushing face of the push block 7 and the area of the recessed portion 5, and the location that the push block 7 pushes against the recessed portion 5 is not good; therefore, when the restraining block 4 is stressed by rotation of the ratchet wheel 2, the restraining block 4 is unable to evenly apply force on both the push block 7 and the elastic piece 8, thus resulting in misgivings that the structure of ratchet wrench may stop operating in use and that the ratchet wrench may cause structural damage. In addition, the components of the conventional ratchet wrench is too numerous and hence more molds must be made, thus increasing manufacturing cost and complicating assembly procedure. In view of above-mentioned situation, the inventor of this invention thinks that the structure of the conventional ratchet wrench is necessary to be ameliorated and hence devises this invention.

SUMMARY OF THE INVENTION

The objective of this invention is to offer a ratchet wrench structure, able to simplify the number of components and further ameliorate the condition that the elastic member is unable to completely support the restraining block.

The ratchet wrench structure in the present invention includes a main body having an acting end formed therein with an accommodating groove, an insert groove and a stop groove positioned between the accommodating groove and the insert groove, letting the accommodating groove, the stop groove and the insert groove communicate with one another. A ratchet wheel is fitted in the accommodating groove and has its circumferential side annularly provided with gear teeth, and a restraining block is slidably set in the stop groove. The restraining block has one side adjacent to the ratchet wheel provided with gear teeth and another side disposed with two longitudinal and juxtaposed recessed portions whose height is the same as that of the restraining block. An actuating member is pivotally received in the insert groove, formed with a position-limiting groove corresponding to the recessed portion of the restraining block, and the position-limiting groove is a rectangular recessed groove with a longitudinal long side. An elastic member is mounted in the position-limiting groove and the elastic member is rectangle-shaped corresponding with the rectangular position-limiting groove and further, the longitudinal height of the elastic member is approximately corresponding with the height of the recessed portion of the restraining block.

When the elastic member of this invention is actuated to optionally push against one of the two recessed portions, the longitudinal front edge of the elastic member can evenly press against the recessed portion to enable the restraining block and the ratchet wheel to produce better engagement effect. Further, when the restraining block is under the stress of rotation of the ratchet wheel, the restraining block can evenly exert force to press the elastic member, letting the restraining block able to carry out reciprocating movement because of extension and contraction of the elastic member. By so designing, the elastic member is able to support the restraining block in its entirety and the restraining block can exert force on the elastic member comparatively evenly and thus, the ratchet wrench structure of this invention is simplified in number of components.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
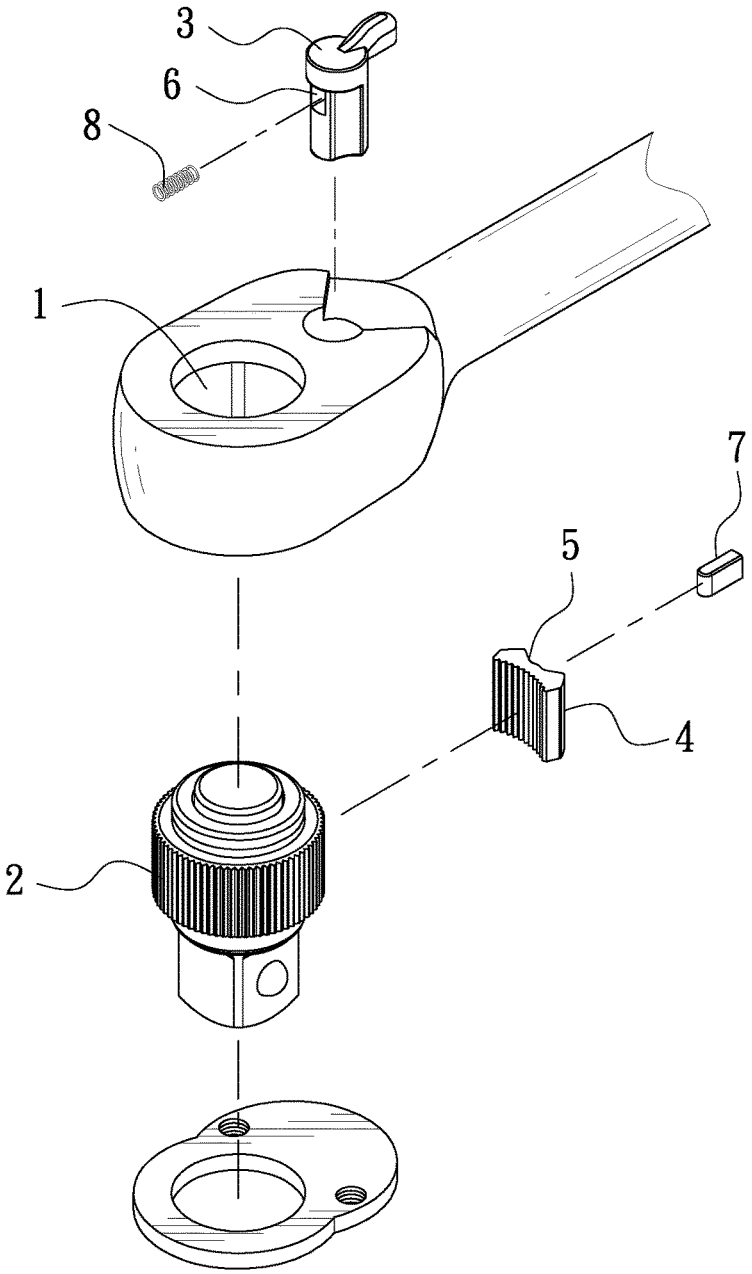
FIG. 1 PRIOR ART
FIG. 1 is an exploded perspective view of a conventional ratchet wrench.
Figure 2:
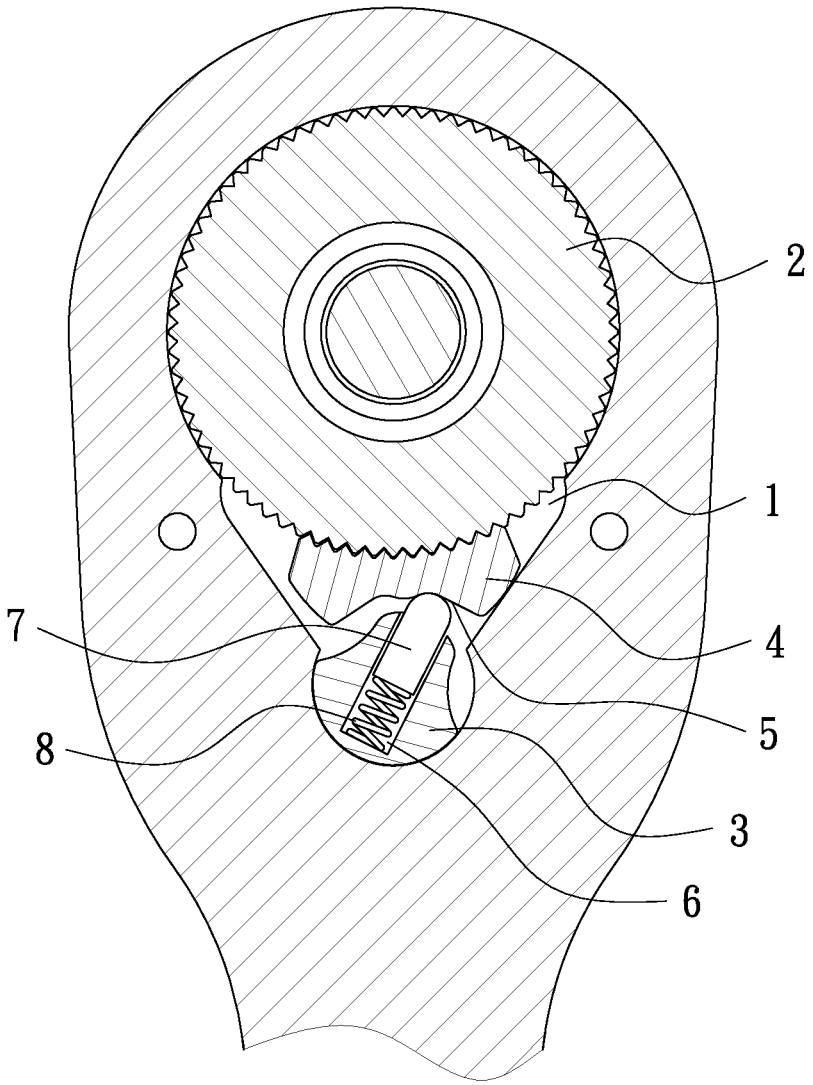
FIG. 2 PRIOR ART
FIG. 2 is a cross-sectional view of the conventional ratchet wrench.
Figure 3:
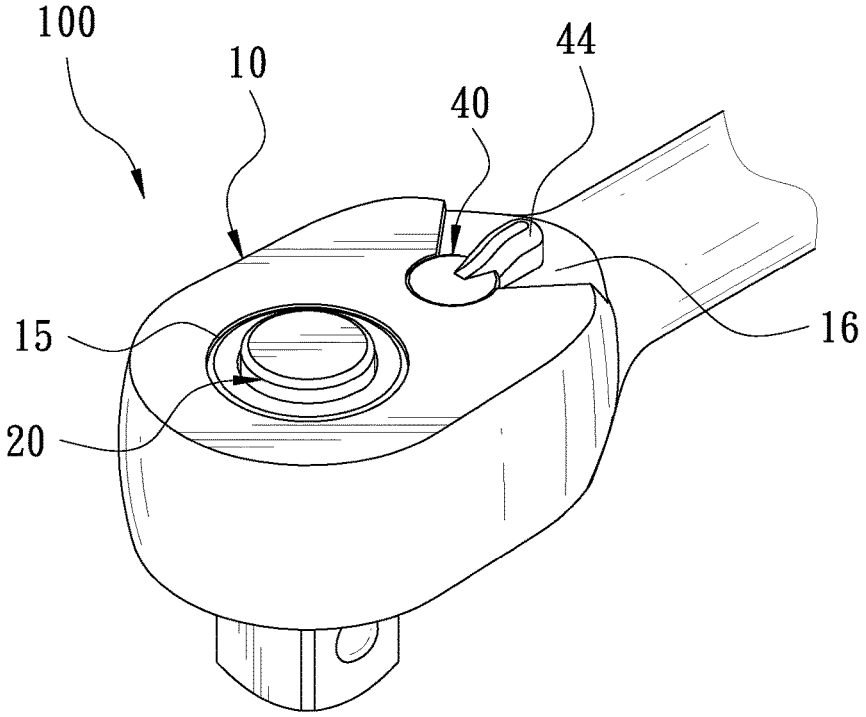
FIG. 3 is a perspective view of a ratchet wrench structure in the present invention.
Figure 4:
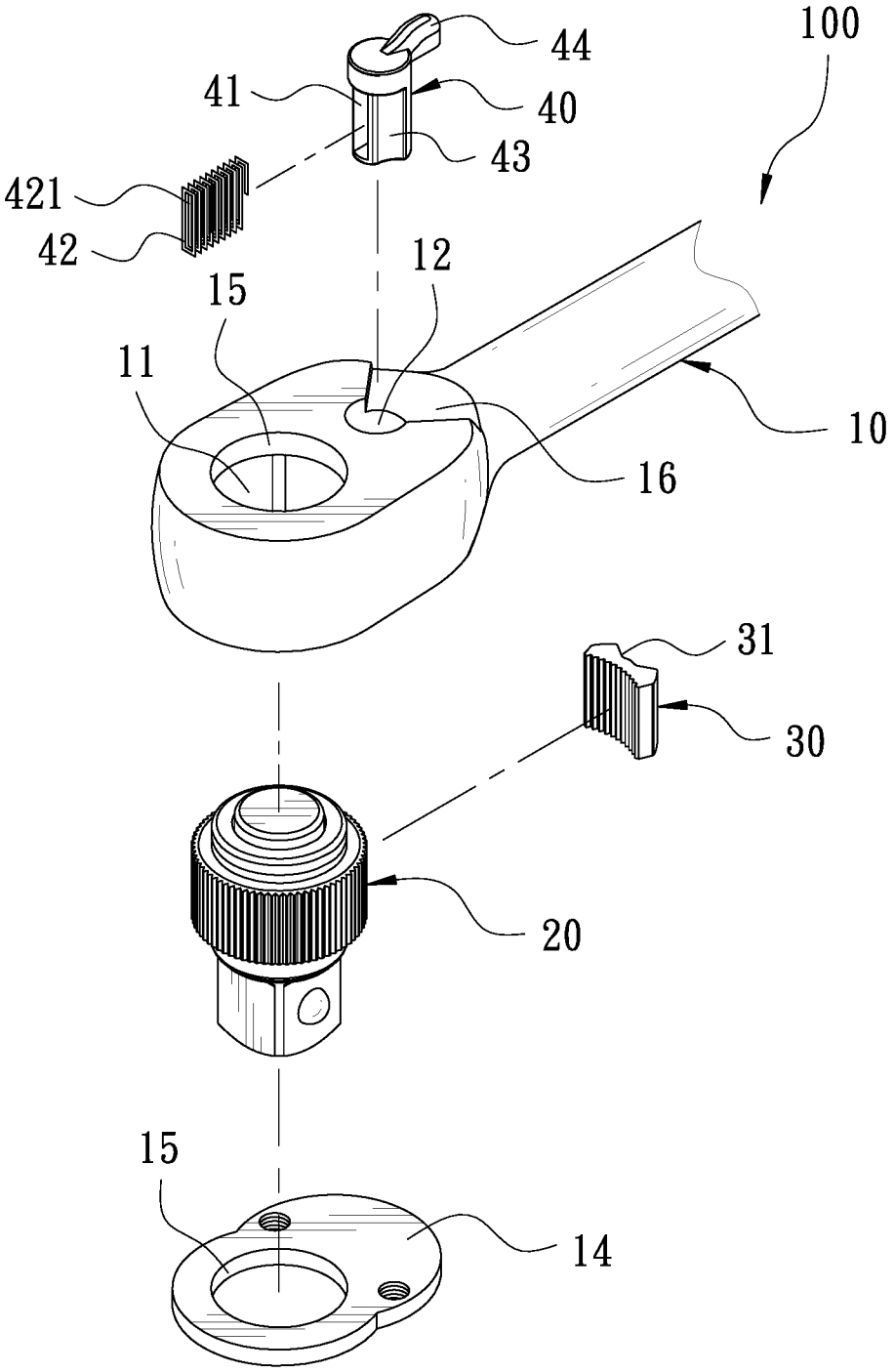
FIG. 4 is an exploded perspective view of the ratchet wrench structure in the present invention.
Figure 5:
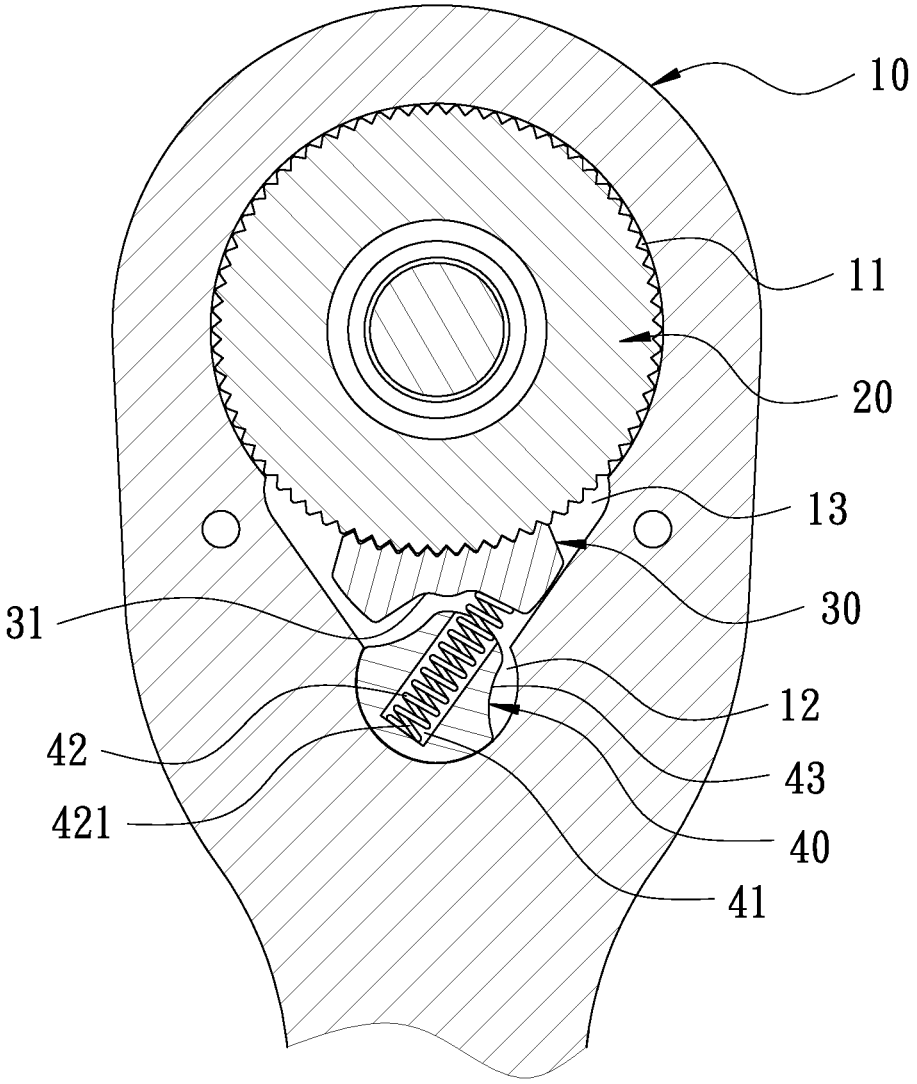
FIG. 5 is a cross-sectional view of the ratchet wrench structure in the present invention.

A preferred embodiment of a ratchet wrench structure 100 in the present invention, as shown in FIGS. 3-5, includes a main body 10, a ratchet wheel 20, a restraining block 30 and an actuating member 40 as main components combined together.

The main body 10 has an acting end provided therein with an accommodating groove 11, an insert groove 12 and a stop groove 13 positioned between the accommodating groove 11 and the insert groove 12. The accommodating groove 11, the stop groove 13 and the insert groove 12 communicate with one another and have a common cover 14 covered thereon, and the cover 14 and the main body 10 are respectively bored with an insert hole 15. The insert groove 12 is cylinder-shaped, and the main body 10 further has its surface formed with a position-limiting district 16.

The ratchet wheel 20 received in the accommodating groove 11 has its circumferential side annularly provided with gear teeth and the ratchet wheel 20 protrudes out of the main body 10 through the inert hole 15.

The restraining block 30 slidably mounted in the stop groove 13, has one side adjacent to the ratchet wheel 20 provided with gear teeth and another side formed with two longitudinal and juxtaposed recessed portions 31, which are equal to the restraining block 30 in height.

The actuating member 40 pivotally assembled in the insert groove 12 is formed with a position-limiting groove 41 corresponding to the recessed portion 31 of the restraining block 30. The position-limiting groove 41 is a rectangular recessed groove with a longitudinal long side and has an elastic member 42 received therein. The elastic member 42 is rectangle-shaped corresponding with the shape of position-limiting groove 41, and the longitudinal height of the elastic member 42 is approximately corresponding to the height of the recessed portion 31, the elastic member 42 being a spring 421. The position-limiting groove 41 of the actuating block 40 has two sides, corresponding to the peripheral edges of the restraining block 30, respectively provided with a recess 43 to avoid producing interference when the actuating member 40 is rotated. The actuating member 40 has its topside exposed to the position-limiting district 16 at the surface of the main body 10 and fixed thereon with a turning lever 44 able to be turned left and right at the position-limiting district 16 for controlling the actuating member 40 to rotate left and right.

Figure 6:
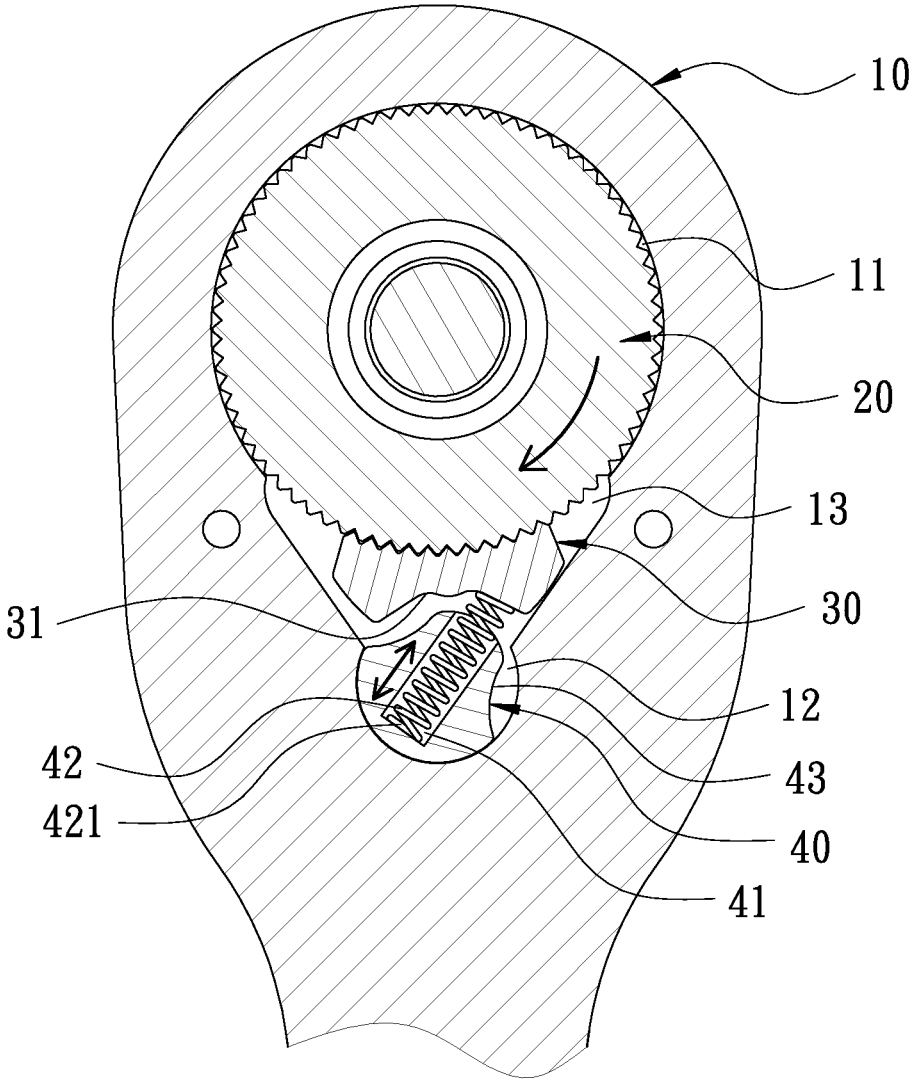
FIG. 6 is a schematic view of the ratchet wrench structure in a using condition in the present invention, showing a state that the actuating member controls the ratchet wheel to rotate clockwise only.

Referring to FIG. 6, when the restraining block 30 is stressed by rotation of the ratchet wheel 20, the restraining block 30 will exert force to press against the spring 421 and thus, the restraining block 30 can be actuated to carry out reciprocating movement by extension and contraction of the spring 421.

Referring to FIG. 6, when the actuating member 40 is turned rightward, the spring 421 will be actuated to push against the restraining block 30 to slide rightward in the stop groove 13, letting the front edge of the spring 421 press the peripheral edge of a corresponding recessed portion 31 to have one corresponding sidewall of the restraining block 30 pushing against the inner wall of the stop groove 13. Thus, limited by the restraining block 30, the ratchet wheel 20 can be only rotated clockwise, attaining an effect that the ratchet wheel 20 can be controlled to rotate clockwise only by means of the actuating member 40.

Figure 7:
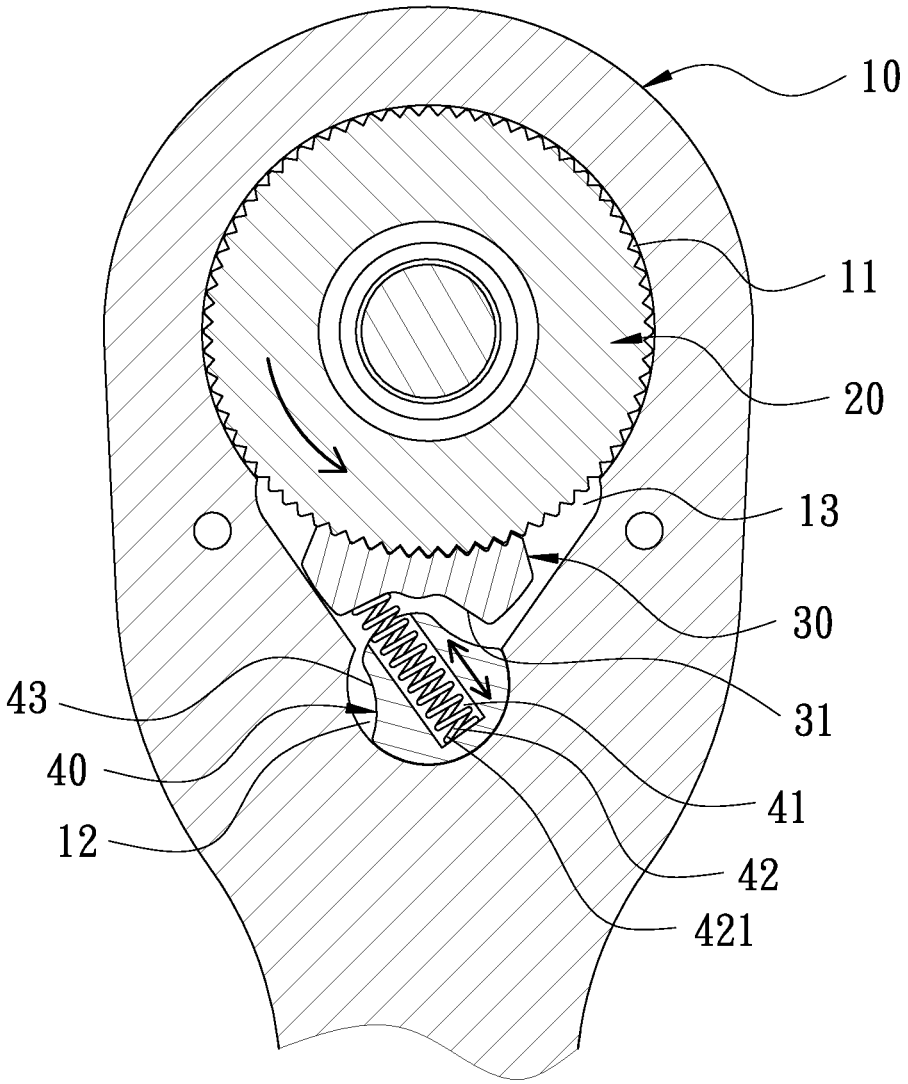
FIG. 7 is a schematic view of the ratchet wrench structure in a using condition in the present invention, showing a state that the actuating member controls the ratchet wheel only to rotate counterclockwise.

Referring to FIG. 7, when the actuating member 40 is turned leftward, the spring 421 will be actuated to push against the restraining block 30 to make the restraining block 30 slide leftward in the stop groove 13, letting the front edge of the spring 421 press against the peripheral edge of a corresponding recessed portion 31 to have one corresponding sidewall of the restraining block 30 pushing against the inner wall of the stop groove 13. Thus, since the ratchet wheel 20 is limited by the restraining block 30, the ratchet wheel 20 can be merely rotated counterclockwise, able to attain an effect that the actuating member 40 can be operated to control the ratchet wheel 20 to rotate counterclockwise only.

Figure 8:
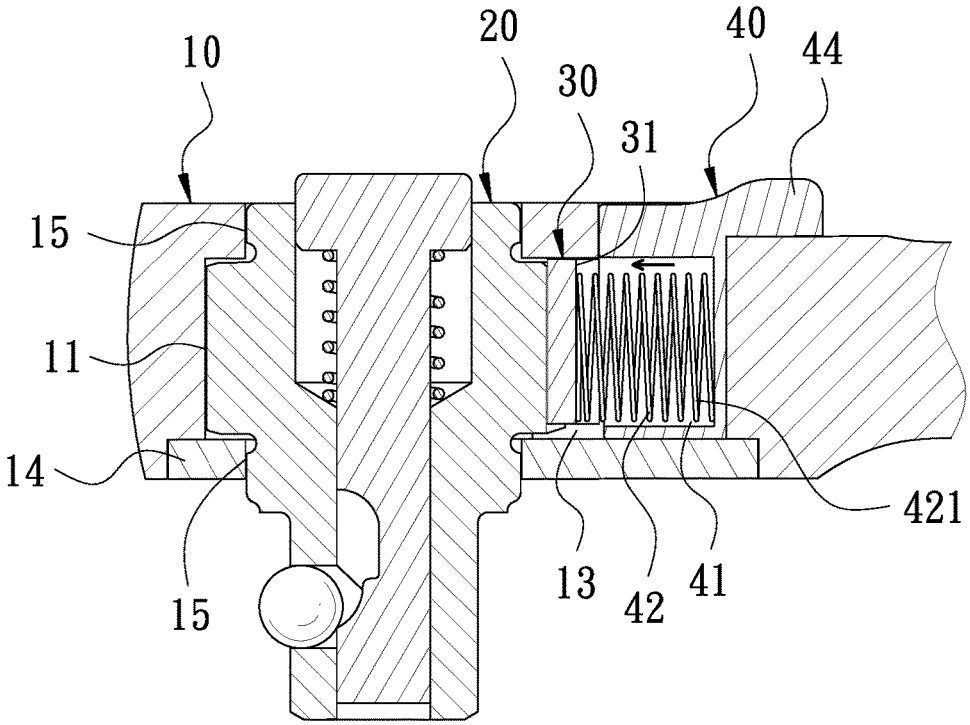
FIG. 8 is across-sectional view of the ratchet wrench structure in the present invention, showing a state that the restraining block is evenly stressed by the ratchet wheel and the elastic member.

Referring to FIG. 8, since the longitudinal heights of both the position-limited groove 41 and the spring 421 are approximately corresponding with the height of the recessed portions 31; therefore, when the restraining block 30 is pressed by both the spring 421 and the ratchet wheel 20 at the same time, the longitudinal front edge of the spring 421 can evenly push against the recessed portion 31 of the restraining block 30 to enable the restraining block 30 and the ratchet wheel 20 to produce better engagement effect. By so designing, when the ratchet wheel 20 is rotated, the ratchet wheel 20 can apply force on the spring 421 via the restraining block and meanwhile, the spring 421 can support the restraining block 30 in its entirety, letting the ratchet wheel 20 able to evenly apply force on the restraining block 30 and further enabling the restraining block 30 to apply force on the spring 421 more evenly. And, compared with the conventional ratchet wheel, the ratchet wrench structure 100 of this invention is much more simplified in number of components.

While the preferred embodiment of the invention has been described above, it will be recognized and understood that various modifications may be made therein and the appended claims are intended to cover all such modifications that may fall within the sprit and scope of the invention.

What is claimed is:

1. A ratchet wrench structure comprising: a main body provided with an acting end, said acting end formed therein with an accommodating groove and an insert groove, said accommodating groove having a ratchet wheel assembled in the interior, said ratchet wheel having a circumferential side annularly provided with gear teeth, a stop groove formed between said accommodating groove and said insert groove, said accommodating groove and said stop groove and said insert groove communicating with one another, an restraining block slidably received in said stop groove, said restraining block having one side adjacent to said ratchet wheel provided with gear teeth, said restraining block having another side disposed with two longitudinal and juxtaposed recessed portions, said recessed portions and said restraining block being the same in height, and characterized by an actuating member pivotally assembled in said insert groove, said actuating member formed with a position-limiting groove corresponding to said recessed portion of said restraining block, said position-limiting groove being a rectangular recessed groove with a longitudinal long side, said position-limiting groove received therein with an elastic member, said elastic member being rectangle-shaped corresponding with said position-limiting groove, a longitudinal height of said elastic member approximately corresponding with a longitudinal height of said recessed portion; thus, said elastic member actuated to optionally push against one of said two recessed portions of said restraining block, said elastic member having a longitudinal front edge evenly pressing against said recessed portion to enable said restraining block and said ratchet wheel to produce better engagement effect, further, said restraining block able to evenly exert force to press against said elastic member when said restraining block is stressed by rotation of said ratchet wheel, said restraining block able to carry out reciprocating movement because of extension and contraction of said elastic member.

2. The ratchet wrench structure as claimed in claim 1, wherein said actuating member has topside exposed to a surface of said main body, and said actuating member has the topside provided with a turning lever.

3. The ratchet wrench structure as claimed in claim 2, wherein said positioning groove of said actuating member has two sides respectively provided with a recess corresponding to peripheral edges of said restraining block so that said actuating member may not produce interference when operated to rotate.

4. The ratchet wrench structure as claimed in claim 1, wherein said elastic member is a spring.

* * * * *